United States Patent [19]

Moses

[11] Patent Number: 4,762,993

[45] Date of Patent: Aug. 9, 1988

[54] DIRECTIONAL SENSOR FOR NEUTRAL PARTICLE BEAMS

[76] Inventor: Kenneth G. Moses, 17 Via Seville, Rolling Hills Estates, Calif. 90274

[21] Appl. No.: 1,768

[22] Filed: Jan. 9, 1987

[51] Int. Cl.[4] ..... H05H 3/00

[52] U.S. Cl. ..... 250/251; 324/71.3

[58] Field of Search ..... 250/251; 324/71.3

[56] References Cited

U.S. PATENT DOCUMENTS

| | | | |
|---|---|---|---|
| 3,419,718 | 12/1968 | Hammond et al. | 250/49.5 |
| 4,056,728 | 11/1977 | LeBoutet | 250/396 R |
| 4,360,760 | 11/1982 | Brodowski | 315/5.41 |
| 4,367,411 | 1/1983 | Hanley et al. | 250/492.2 |
| 4,442,352 | 4/1984 | Brahme | 250/251 |
| 4,455,532 | 6/1984 | Gregory et al. | 324/457 |
| 4,480,185 | 10/1984 | Harshimoto | 250/251 |

OTHER PUBLICATIONS

The Review of Scientific Instruments, "Double Focusing with Wedge-Shaped Magnetic Fields", vol. 22, No. 3, p. 197, M. Camac, Mar. 1951.

The Review of Scientific Instruments, "Two-Directional Focusing of Charged Particles with a Sector--Shaped, Uniform Magnetic Field", vol. 22, No. 10, p. 717, William G. Cross, Oct. 1951.

The Review of Scientific Instruments, "Improved Magnetic Focusing of Charged Particles", vol. 20, No. 1, Larkin Kerwin, Jan. 1949, p. 36.

The Review of Scientific Instruments, "Improved Magnetic Focusing of Charged Particles", vol. 20, No. 8, p. 748, H. Hinteberger, Aug. 1949.

Enge, H. A., *Focusing of Charged Particles,* Academic Press, New York, 1967, vol. II, Chapter 4.2, "Deflecting Magnets".

*Primary Examiner*—Craig E. Church
*Assistant Examiner*—Jack I. Berman
*Attorney, Agent, or Firm*—Fitch, Even, Tabin & Tabin

[57] ABSTRACT

A method and apparatus senses the deviation of a neutral particle beam from a predetermined direction. The neutral particle beam is derived from a composite particle beam having residual charged particles with substantially the same directional characteristics as the neutral particles making up the neutral particle beam. A deflection magnet deflects at least a portion of the charged particles from the composite particle beam a known amount toward a detector array including apertures for forming a plurality of charged particle beamlets. Deviation of the charged particle beamlet is determined as an indication of the direction of the neutral particle beam relative to the predetermined direction.

A similar measurement of neutral particles around the periphery of the neutral beam provides deviation data of the neutral beam which, when correlated with the data of the charged particle beam, provide an instantaneous transfer characteristic of the magnetic deflection system.

17 Claims, 2 Drawing Sheets

DIRECTIONAL SENSOR FOR NEUTRAL PARTICLE BEAMS

BACKGROUND OF THE INVENTION

1. Field of the Invention

The present invention relates generally to nonintrusive arrangements for determining the direction of a neutral particle beam, particularly by measurement of residual charged particles having the same directional characteristics as neutral particles making up the neutral particle beam.

2. Description of the Prior Art

Various areas of technology today employ neutral particle beams. In addition to civilian uses such as heating of fusion plasmas and medical research, neutral beams have military importance as potential weapons used both in the earth's atmosphere and out in space. Any of the practical uses of neutral beams require an ability to direct the beam in a controlled manner. A fundamental aspect of such beam control is determining the direction of a neutral beam at any point in time. A problem here is in determining the direction of neutral particles without interrupting the beam. It is also difficult to detect and measure neutral particles.

Four approaches have been proposed for determining the direction of neutral particle beams. The first is a resonant Doppler-shift laser system which is costly and difficult to operate, requiring highly skilled personnel operating in a highly controlled environment. The second technique, commonly known as the "pinhole" technique, measures the direction of beam samples taken from the periphery of a neutral particle beam. In this second technique, the interior of the beam cross section is not analyzed. This is a significant drawback since neutral beams for several important potential applications may be non-uniform in their cross-sectional and directional properties.

The third technique utilizes laser-induced fluorescence to excite some of the atoms in the beam which are in excited states to higher states. These highly excited beam atoms radiate a short time later, and the angle of interception between the laser beam and the neutral beam which gives the maximum intensity of fluorescence yields a measure of the direction of the neutral beam. This technique suffers from the same problems as the first method. The fourth technique, "wire shadows," employs two wires which intercept the neutral beam. One wire is downstream to the second, and they are in close proximity to each other. The current in the second wire due to the impact of the neutral beam is a measure of the direction of the neutral beam. Difficulties have been encountered in aligning these wires with respect to one another. This alignment problem is further exacerbated by space qualification requirements.

SUMMARY OF THE INVENTION

It is therefore a principal aspect of the present invention to provide a nonintrusive method and apparatus for determining the direction of a neutral particle beam by analyzing a residual charged particle component of a composite particle beam from which the neutral beam has been derived.

It is another aspect of the present invention to provide an on-line, on-board calibration system for the above.

In one of its aspects, the present invention provides a method and apparatus for the direct, free-flight boresighting measurement of charged particles from a composite particle beam which provides the neutral particles of the neutral particle beam, to determine the direction of the neutral particle beam. A related object of the present invention is to provide a method and apparatus for providing the instantaneous transfer characteristics of the system used for deflecting the charged particles away from the composite particle beam.

These aspects, as well as other aspects, objects and advantages will become apparent upon reference to the following detailed description particularly when taken in conjunction with accompanying drawings. They are provided by a nonintrusive apparatus for determining the deviation of a neutral particle beam from a predetermined direction. The neutral particle beam is derived from a composite particle beam also containing charged particles having substantially the same directional characteristics as the neutral particles of the neutral particle beam. The apparatus consists of means for extracting a beam of charged particles from the composite beam in a known manner and beam processing means for determining its directional properties, including means for transmitting a part of the beam therethrough so as to produce at least one charged particle beamlet. Means are included for systematically deflecting the charged particles a known amount from the composite particle beam to form a charged particle beam which is directed toward the beam processing means. Detector means are positioned for detecting the charged particle beamlet. Deviation determining means are provided responsive to the downstream detector means for determining the deviation of the charged particle beamlet from a second direction differing from the predetermined direction by the known amount. The deviation of the charged particle beamlet from the second direction corresponds to the deviation of the neutral particle beam from the predetermined direction.

The present invention includes a nonintrusive method for determining the deviation of a neutral particle beam and/or parts thereof from a predetermined direction. The neutral particle beam is derived from a composite particle beam also containing charged particles having substantially the same directional characteristics as the neutral particles of the neutral particle beam. This method comprises the steps of deflecting the charged particles a known amount from the composite particle beam to form a charged particle beam, and intercepting part of the charged particle beam with a masking means so as to produce at least one charged particle beamlet. The presence of the charged particle beamlet is detected on a detector surface, and the deviation of the charged particle beamlet from a second direction differing from the predetermined direction by a known amount, is determined by measuring on the surface of the detector the deviation of the charged particle beamlet from the second direction, the deviation of the charged particle beamlet from the second direction corresponding to the deviation of the neutral particle beam from the predetermined direction.

BRIEF DESCRIPTION OF THE DRAWINGS

In the drawings, wherein like elements are referenced alike.

DETAILED DESCRIPTION OF THE PREFERRED EMBODIMENT

Figure 1:
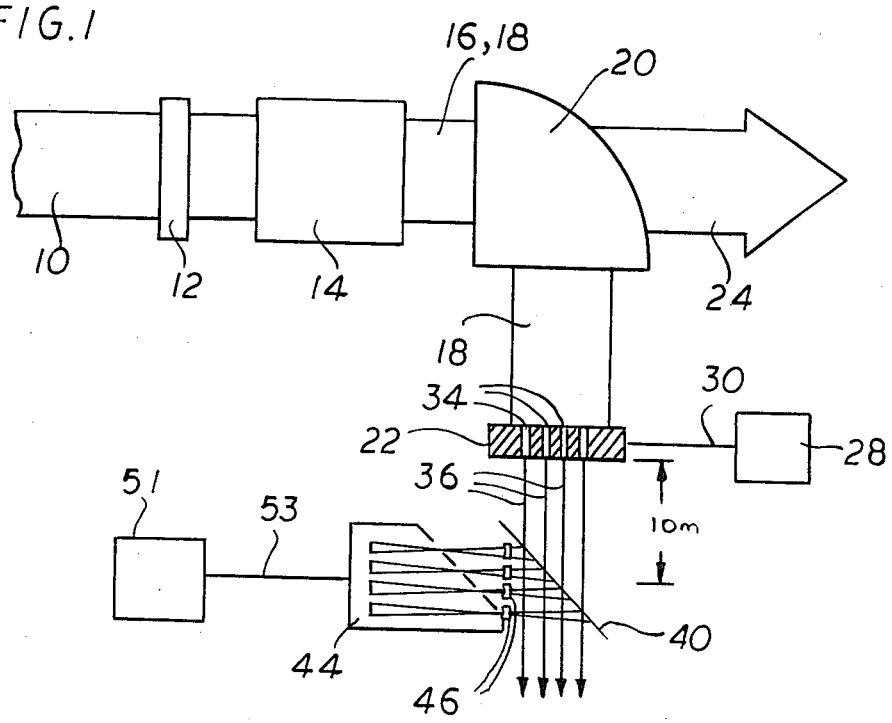
FIG. 1 is a partially diagrammatic elevation view of a neutral particle beam source with a beam direction sensor system embodying various aspects of the present invention.

Referring now to FIG. 1, a nonintrusive neutral particle beam sensor apparatus embodying the principles of the present invention is illustrated in conjunction with a conventional neutral particle beam source. As shown, the source includes an ion beam generator 10, a beam focusing magnet 12 and a neutralizer cell 14. The beam generator 10 typically comprises an ion source and a linear particle accelerator (LINAC) in tandem with a radio frequency quadrapole (RFQ) accelerator. Typically, the ion beam generator accelerates the ions to several hundred Mev. Typical ions or charged particles include negative hydrogen and deuterium ions ($H^-$, $D^-$) and may include negative ions as heavy as $Li^-$. These particles are preferred, because heavier particles are more difficult to manage, and positive particles are more difficult to neutralize.

The final focusing magnet 12 directs the beam of charged particles into the neutralizer cell 14. The charged particles, typically negative ions, are neutralized in the cell 14 where they undergo stripping collisions, exiting as a composite neutral particle beam 16, 18, including a residual charged particle component 18 within the neutral beam 16. The neutralizing cell 14 may be one of many several alternative designs known today. For example, foils, gas cells, plasma neutralizer cells, and laser photodetachment techniques may be employed.

The terms "neutral beam" and "composite neutral beam" will be used hereafter to refer to a practical beam, derived from practical neutralizer cells, and does not necessarily refer to beams consisting exclusively of neutral species. As will become apparent herein, a principle feature of the particle beams utilized in the present invention is that the directional characteristics of the neutral particles of the composite neutral beam are retained in the residual charged beam particles (those remaining after neutralization that are also present in the composite neutral beam 16, 18). Diagnostics to determine directional characteristics will conveniently be performed on a deflected residual charged particle component 18.

As mentioned above, not all incoming particles are neutralized in the cell 14, and as explained above, the exiting composite neutral particle beam 16, 18 is a composite beam containing at least one charged particle component 18 (i.e., a particular charged species) utilized by the present invention. Examples of charged particle components include electrons, negative hydrogen ions ($H^-$), negative deuterium ions ($D^-$), and negative lithium ions ($Li^-$).

The composite neutral particle beam 16, 18 is directed through a deflection magnet 20 which operates upon the particular residual charged particle component 18 of that beam, so as to deflect those charged particles toward a processing means which preferably comprises a detector in the array 22. As will be appreciated by those skilled in the art, other charged particle components (i.e., other residual charged species) of beam 16 may be deflected, but only the one component 18 will arrive at array 22. The magnetic field strength of the magnet 20 can be chosen to direct a particular charged particle species toward the detector array 22. Other charged particle species will be deflected elsewhere. The remainder of the composite neutral particle beam, after the charged particles are deflected, is a neutral beam 24. The present invention is directed to a method and apparatus for determining the direction of the neutral beam 24 without intruding or otherwise impeding that beam. To avoid disturbing the neutral beam 24, the present invention analyzes the deflected particles in residual charged particle beam 18.

For convenience, in the preferred embodiment, the magnet 20 was designed to deflect the charged particle component 18 through a 90° angle. The angle of deflection of the magnet 20 is not critical to the present invention. Aberrations that would otherwise appear in the beam 18 due to different velocities of charged particles entering the magnet 20 can be reduced or eliminated using magnet design techniques known in the art today, or accounted for by the online, on board calibration process, as described later.

Two choices of charged particle species are favored in the present invention, electrons and negative ions, with negative ions being the more preferred. Because they have not undergone stripping collisions in the neutralizer cell, these negative ions have a velocity distribution which is sharper than that of the neutral particles with directional characteristics corresponding to those of the neutral particles. Although the negative ions have a relatively sharper velocity distribution, which is directly related to the output of the accelerator 10, their use in the present invention requires magnetic fields of substantial strength, on the order of 1.0 T, to deflect them appropriately from the composite beam 16. If this becomes a prohibitive limitation, the field strength of the magnet 20 may be chosen to select residual electrons from the composite beam 16. Electrons (preferably those having energies in the 100 Key range) require substantially weaker magnetic deflecting fields; however, they have a broader velocity distribution and are less directly related to the output of accelerator 10. Either charged particle type may be employed in the practice of the present invention.

As mentioned above, the beam processing means 22 includes an array of detectors. These are preferably conventional energetic particle detectors such as scintillation detectors which can measure beam intensity. The magnetic deflection of the magnet 20 will map the spatial and velocity distribution of charged particles of the beam 18 onto the detector array 22. It has been found that the phase space, i.e., the directional, characteristics of the residual charged particle beam 18 bear a direct relationship to those of the composite beam 16. Accordingly, mapping of the spatial and velocity distribution of the residual charged particle beam 18 onto the detector array 22 can be advantageously employed to provide a diagnostic for obtaining the cross-sectional number-density distribution, as well as the centroid, of the residual charged particle beam 18. Such distribution and centroid can be readily obtained by those skilled in the art, and will not be addressed herein. Such distribution and centroid can be empirically related to those of the neutral particle beam 24 to provide a measure thereof. Electronic circuitry 28 is connected to the array 22 by a line 30 for polling the detector array and performing the required diagnostic steps to determine the centroid and cross-sectional, number-density distribution of the charged particle beam 18 and, hence, of the neutral beam 24.

In the embodiment illustrated in FIG. 1, the detector array 22 includes a series of apertures 34 through which portions of the beam 18 can pass unimpeded. Those portions are referred to herein as charged particle beamlets 36. The combination of the focusing of the initial ion beam and the following deflection magnet 20 with the apertures 34 provide well-defined beamlets. An important feature of the present invention is that apertures 34 be arranged at selected locations over the entire cross section (i.e., interior as well as periphery) of the charged particle beam 18.

Figure 2:
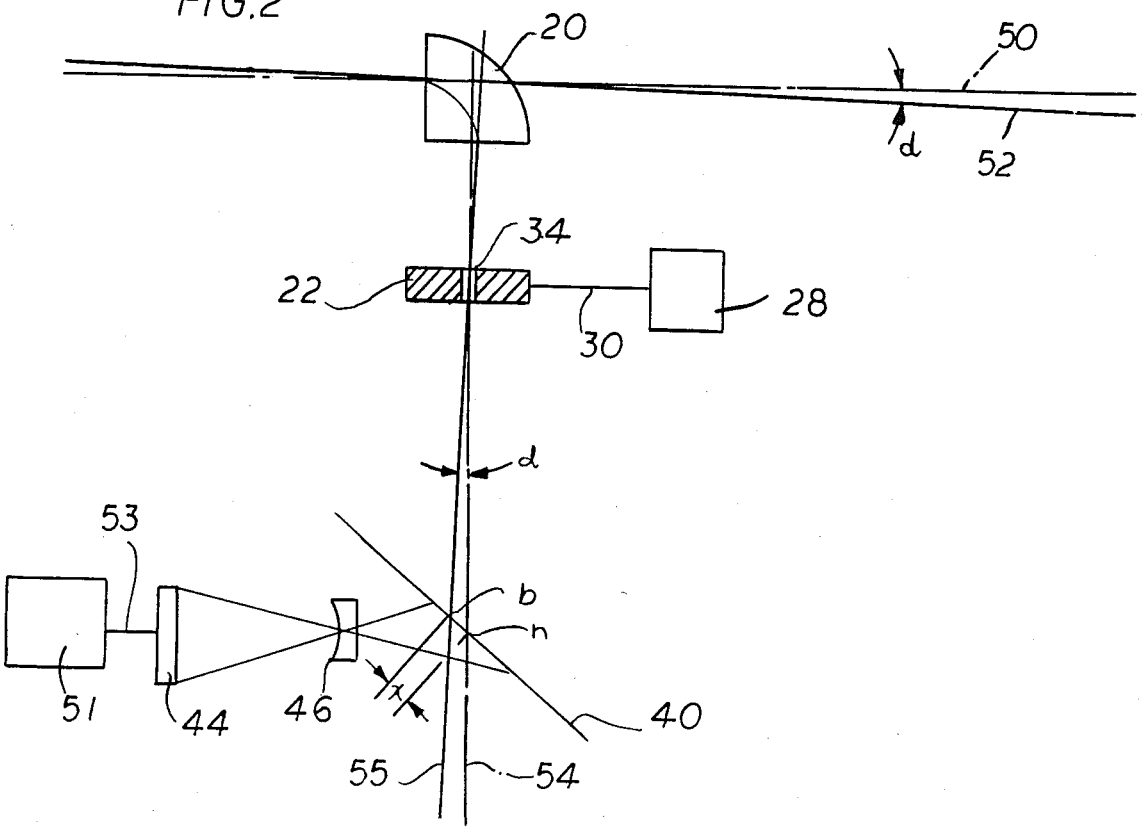
FIG. 2 is a diagrammatic illustration of the principles of operation of the system of FIG. 1.

In operation of the present invention, directional analysis is made beyond (i.e., downstream of) the array 22 on each individual beamlet 36. As illustrated in FIGS. 1 and 2, the present invention forms a direct, free-flight boresight measurement of the direction of each beamlet 36. The distribution of particles (especially negative ions) in the charged particle beam 18 is narrower than the distribution of neutral particles in neutral beam 24. Accordingly, the present invention, which analyzes the narrower distribution of the charged particle beam is termed a "boresight" technique. The directional characteristics of the deflected residual charged particle beam 18 are mapped into a one-to-one correspondence and a 90° relationship with respect to the composite beam 16 by the magnet 20. The detector array 22 intercepts the residual charged particle beam 18 so as to leave the beamlet samples of the beam at a series of discrete, spaced-apart points (via the apertures 34). The beamlets 36 emanate from the planar detector array 22 in a direction representative of the direction of the neutral beam 24. In this example with 90° definition, downstream-directed lines 54 are perpendicular to a predetermined reference direction of the neutral beam. The lines 54 provide reference points on a foil 40. The foil 40 is inclined at a known angle to the normal lines 54. The region between the foil 40 and the array 22 is maintained free of deflecting fields, permitting the free drift of the deflected ions in respective beamlets 36.

Each beamlet 36 incident on the foil 40 produces an optical image of the beamlet cross section on both opposed foil surfaces, as the charged particles making up the beamlet locally activate the foil as they pass through. The foil 40 is made from any conventional material known in the art to provide fluorescence and have the desired properties. For purposes of the illustrated embodiment, those properties must be sufficient to provide an adequate optical image in a camera 44 which contains an array of charged couple device (CCD) detectors. The beamlet images are magnified, in the example by a factor of 10, by lenses 46 before being viewed by the camera 44. The camera 44 must have a resolution sufficient to measure a deviation of a beamlet 36 from its normal line 54 to the array 22, as will be explained shortly. The deviation, as contemplated in the illustrated embodiment, is an angular deviation. One example of a commercially available camera, Reticon Image Sensor no. RA256X256, offers 65,536 pixels at a spatial resolution of 40 micrometers. Other important performance specifications of this camera are a 5 MHz sampling rate and a framing rate of 76 frames per second, which determines the bandwidth of the overall angle-determining system.

Referring now to FIG. 2, operation of the present invention will be described in respect to the preferred reference direction line 50 indicating a reference direction for the neutral particle beam 24. As will be noted, the neutral particle beam 24 is not interrupted during the determination of its direction. FIG. 2 illustrates the arrangement and geometry for a single beamlet 36. Actually, as shown in FIG. 2, the directions of beamlets 36 corresponding to the entire beam cross section are determined. In the example shown, the actual direction of the beam 24 is indicated by a line 52, which differs from the direction line 50 by an angle d. The magnet 20 is configured to deflect the charged particle component exactly 90°, and the resulting direction of the charged particle beamlet 36, as indicated by a line 55 is also offset at an angle d from the normal line 54 perpendicular to direction 50. The angle d is directly determinable from the distance x measured on a surface of foil 40 between the intercepts of the lines 55 and 54. As indicated, the foil 40 is inclined at an angle, preferably 45°, to the normal line 54 to facilitate an off-axis location for the lenses 46 and the camera 44. The outer ray lines of FIG. 2 indicate a viewing envelope over which the surface of foil 40, adjacent the beamlet 36, is monitored.

Foil 40, in the illustrated embodiment, is spaced 10 meters from the detector array 22 whose apertures 34 are preferably 0.1 mm ($10^{-4}$ meters) in diameter. Assuming, for example, a charged beamlet 36 has an angular deviation (angle d) of $10^{-6}$ radians from the normal to detector array 22, after drifting 10 meters in field-free space, the particles making up the beamlet image are displaced laterally $10^{-5}$ meters from the normal to array 22, on the surface of the foil 40. The normal to the array intersects the foil 40 at point n, and the centroid of the beamlet intersects the surface of foil 40 at point b. The distance x between points b and n is $10^{-5}$ meters long times a geometrical factor dependent upon the angle of the foil to the beamlet 36, and represents the corresponding translation on the surface of foil 40 of an angular deviation d of $10^{-6}$ radians. The schematic diagram of FIG. 2 is not drawn to scale, so that the angular deviation d can be made clearly visible.

The beamlet image on the foil (centered about point b) is optically magnified by a 10x lens and focused onto the surface of the CCD detector array of camera 44. When magnified, the $10^{-5}$ meters long deviation x (as measured on the surface of foil 40) becomes a distance of $10^{-4}$ meters times the geometrical factor times another geometrical factor as mapped on the surface of camera 44, yielding a resolution of $10^{-2}$ radians per meter of camera surface. With the foil 40 at an angle of 45° to the direction 54, the geometrical factors are reciprocals of each other and balance out. With the above-described camera, having 65,536 pixels and a spatial resolution of 40 micrometers, the angular resolution of the overall beamlet sensing system (comprising the detector array 22, foil 40, lens 46 and camera 44) is $4 \times 10^{-7}$ radians per pixel.

The beamlet forming apertures have a 0.1 mm diameter and the focal length between the detector array 22 and the foil 40 is 10 meters in the illustrated embodiment. The present invention, however, contemplates ratios of focal length to beamlet-forming diameter lying in the range of $10^3$ to $10^7$, and not limited to the $10^5$ ratio of the illustrated embodiment.

Conventional circuitry 51 correlates measurements for all beamlets, and may be used for processing the data from the detectors of the camera 44, via a line 53, to determine the directions of respective beamlets 36. If the image intensity for a given beamlet sensing system does not have a Gaussian distribution, but rather is uniform over the cross-sectional area of the beamlet, the displacement of the beamlet can be measured by determining the centroid of the beamlet image on camera 44. Other, higher resolution, cameras may be employed if desired, and the use of other types of cameras is contemplated by the present invention.

From the arrangement described herein, particularly the one-to-one correspondence between the characteristics of the deflected charged beam and the neutral beam, it will be readily appreciated that the measured angular deviations of the charged particle beamlets correspond to the angular deviations of corresponding parts of the neutral particle beam, and that the position and direction of the centroid of the charged particle beam 18 can be determined. This is important since the position and direction of the centroid of the charged particle beam 18 correspond to the position and direction of the centroid of the neutral particle beam 24. This latter correspondence can be verified empirically, if desired, by interrupting central portions of the neutral particle beam 24 to produce and detect beamlets, in the manner described above for the charged particle beam and the periphery of the neutral particle beam. This determination must be made at times when the neutral particle beam is not needed to be delivered to its intended target. The mask used to interrupt the neutral beam may not be able to withstand the full power of the neutral beam 24. The accelerator can be made to operate at reduced power, or the total flux of the neutral beam can be reduced to avoid destruction of the mask.

Figure 3:
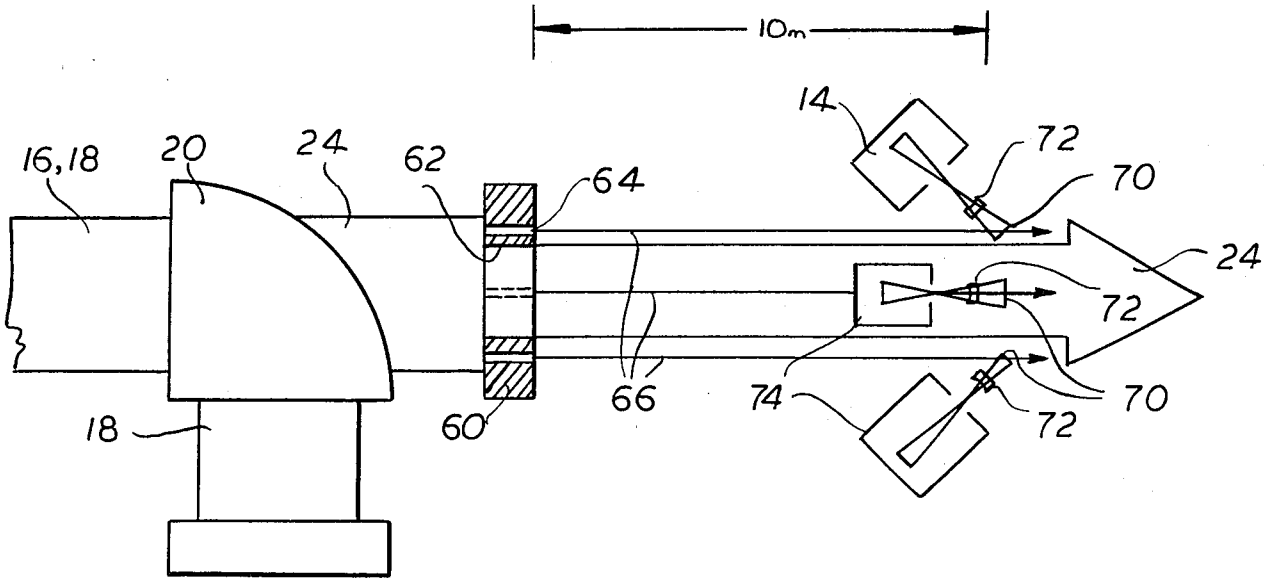
FIG. 3 is a partially diagrammatic and partially sectional view showing the right-hand portion of the system shown in FIG. 1 with additional calibrating apparatus embodying other aspects of the present invention.

Referring now to FIG. 3, an additional feature of the present invention, that of providing an on-line, on-board calibration between the neutral beam 24 and the detected charged particle beamlets, will be described. FIG. 3 illustrates an extension of the righthand portion of the apparatus shown in FIG. 1, and shows additional beam-sensing apparatus located along the neutral particle beam 24 downstream of the deflection magnet 20. A beam limiting collar 60 is disposed about the periphery of neutral particle beam 24 to interrupt the periphery of the beam. The great majority of the beam passes unimpeded through the center 62 of the collar 60. Four pinhole apertures 64 are positioned in quadrature about the collar 60 to form four peripheral neutral particle beamlets 66. Only three beamlets 66 are visible on the elevational view of FIG. 3, because of the two overlying beamlets at the centerline of the neutral particle beam 24. Although the illustrated embodiment employs four apertures in quadrature about the collar 60, other arrangements of apertures are possible. For example, an array of three apertures, spaced at 120° intervals about the collar 60 will provide sufficient information from which a determination of the direction of neutral beam 24 can be made. Additional apertures can be provided if the periphery of neutral beam 24 is suspected to be non-uniform. According to the present invention, any apertures in collar 60 are located at or near the periphery, so as to avoid interfering with the center of beam 24.

A sensing system similar to that of FIG. 2 is positioned downstream of the apertures 64 in the collar 60. The system includes four inclined detectors, preferably comprising fluorescing foils 70, intersecting respective beamlets 66 at an angle of 45° to the reference direction 50. Neutral particles passing through the foils 70 cause a fluorescence of the foils which is magnified by 10x lenses 72 and CCD-type cameras 74, which may be identical to those employed in the system shown in FIG. 2. Suitable circuitry associated with the cameras 74 processes the data from the CCD detectors of the cameras 74, determines the point of maximum beamlet intensity for Gaussian beamlet distributions, and determines the beamlet centroid for cross-sectionally uniform beamlet intensities.

In the illustrated embodiment, observation of the angular deviation of the beamlets of the neutral particle beam 24 is identical to that described above for the charged particle beam since foils 70 are also placed 10 meters downstream of their beamlet source (collar 60) and since identical "normal" lines (i.e., parallel to the direction 50), lenses, cameras and data processing circuitry are used. Measurements of the angular deviations of the peripheral neutral particle beamlets 66 are made in the manner described above and are compared or correlated with corresponding data for their counterpart charged particle beamlets 36 (i.e., those beamlets taken from corresponding peripheral locations, also in quadrature, about the charged particle beam 18).

This comparison yields the instantaneous transfer characteristics of the magnetic deflection system and can be performed on-line, in real time, by a conventional computer system (not shown) which correlates the two sets of data to calibrate the deflected charged particle beam sensing system to the direction of the neutral particle beam 24 at the four peripheral points of the illustrated embodiment. It has now been made apparent that the transfer characteristic provides a measure of the instrumental error of the directional difference between the four peripheral charged particle beamlets with respect to their four corresponding neutral particle beamlets introduced by the magnetic deflecting process. This information can be provided to a control system controlling the direction of the neutral particle beam on a real time basis.

The conformity of directional measurements made on the internal portions of the charged particle beam cross section (measurements yielding location and particle distribution in both position and velocity space about the charged particle beam centroid) with similar conditions in the neutral particle beam can be validated empirically in advance of the operation of the neutral beam system for its intended purpose. That is, empirical determinations can be made over the entire neutral beam cross section to correlate the charged particle measurement therewith over the entire cross section. Then in operation, the correlation of the peripheral measurements can be used to provide on-line calibration for the system. Correction factors for any distortions of the magnetic field can be determined from a comparison of the data of peripheral charged particle and neutral particle beamlets, and these correction factors can be applied to data taken from the internal charged particle beamlets to obtain an inference of neutral beam direction and time-space distribution at various points internal to the neutral particle beam 24. It will be readily appreciated that both charged and neutral particle beam sensing systems are referenced to the same reference coordinate system, and that the relative position of all apparatus elements described above can be accurately monitored by conventional systems, such as laser interferometer systems.

While only one technique of analyzing the directionality of charged particle beamlets (i.e., "boresighting") has been described in detail, those skilled in the art will appreciate that other techniques are also possible with the present invention. For example, resonant cyclotron heating can be employed to generate electromagnetic waves which interact selectively with charged particles having velocity components perpendicular to an imposed magnetic field. To this end, electromagnetic waves satisfying the second-harmonic ion-cyclotron resonance conditions with the negative ions of the charged particle beam may be employed for non-linear heating of the charged particle's perpendicular velocity component. Angular deviation of the charged particles is determined by measuring the radial displacement, produced by the heating process, from the line of magnetic flux at the point where the particle enters the magnetic field. In this alternative technique, the direction of the magnetic field is maintained static, so as to provide a frame of reference. The transferred energy increases non-linearly the orthogonal velocity of the beamlet centroid relative to the direction along the static magnetic field. The growth of the gyration radius of the beamlet centroid about the magnetic field line emanating at the center of the entrance aperture is measured by an array of detectors at the end of the magnetic field. The length of the drift space is determined by the heating rate required to produce a measurable radial growth.

In another alternative arrangement for determining the angular deviation of the charged particles, the cyclotron emission of the particles is measured. It is well known that charged particles moving with a constant speed with velocity components perpendicular and parallel to a magnetic field, gyrate about a line of flux while moving along the flux line. The particles, accordingly, experience an acceleration due to the centrifugal forces attending the gyrating motion. If the particle energy is high enough, its acceleration will cause radiation of electromagnetic waves, i.e., cyclotron emissions, at the frequency of particle gyromotion. The power radiated is strongly dependent upon the component of velocity perpendicular to the field, and, accordingly, measurement of the lateral power can be used to determine the angular deviation of the charged particles.

In still another alternative arrangement for determining lateral deviation, strongly divergent magnetic lenses can be arranged to provide angular magnification of the charged particle trajectories, thereby providing a simple indication of charged particle angular deviation.

Thus, it can be seen that the present invention offers an arrangement for determining the direction of a neutral beam which: does not interfere appreciably with the neutral beam; utilizes residual charged particles which are more readily detected; yields data corresponding to points throughout all portions of the neutral beam cross section, while maintaining measurements of the overall beam properties; and can conveniently provide on-line beam diagnostics.

It is apparent that there has been provided, in accordance with the invention, an arrangement for sensing the direction of the neutral beam that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the invention.

What is claimed is:

1. A nonintrusive apparatus for determining the deviation of a neutral particle beam from a reference direction, where the neutral particle beam is derived from a composite particle beam also containing charged particles having substantially the same directional characteristics as the neutral particles of the neutral particle beam, said apparatus comprising:

deflecting means for systematically deflecting at least a portion of said charged particles a fixed amount from said composite particle beam to form a beam of charged particles;

beam processing means for processing said beam of charged particles including means for freely transmitting a part of said beam therethrough so as to produce at least one charged particle beamlet;

downstream detector means positioned downstream of said beam processing means for detecting said charged particles in said charged particle beamlet; and deviation determining means responsive to said downstream detector means for determining the deviation of said charged particle beamlet from a second direction differing from said reference direction by said fixed amount, said deviation of said charged particle beamlet from said second direction corresponding to the deviation of at least a corresponding part of said neutral particle beam from said reference direction.

2. The apparatus of claim 1 wherein said downstream detector means includes means for intercepting said charged particle beamlet and a detector surface optically indicating the location of said intercepted charged particle beamlet, said detector surface being spaced a predetermined distance from said beam processing means, and wherein said deviation determining means comprises means responsive to said optical indication for measuring the deviation of said charged particle beamlet from said second direction.

3. The apparatus of claim 2 wherein said optical indicating means comprises a layer which fluoresces upon interacting with said charged particle beamlet.

4. The apparatus of claim 2 wherein said means for measuring comprises a camera for viewing said detector surface.

5. The apparatus of claim 1 wherein said beam processing means includes an upstream detector array for detecting charged particles in said beam of charged particles and means responsive to said upstream detector array for determining the centroid of said charged particle beam as an indication of the centroid of said neutral particle beam.

6. The apparatus of claim 5 wherein said beam processing means defines at least one aperture in said detector array for allowing passage of said charged particle beamlet therethrough while intercepting the remainder of the charged particle beam.

7. The apparatus of claim 6 wherein the distance between said detector array and said downstream detector means is between $10^3$ and $10^7$ times larger than a cross-sectional dimension of said at least one aperture.

8. The apparatus of claim 1 wherein said beam processing means transmits a plurality of discrete charged particle beamlets to be detected by said downstream detector means.

9. The apparatus of claim 8 wherein at least one of said charged particle beamlets is taken from said beam of charged particles at an interior location spaced from to the periphery thereof.

10. The apparatus of claim 1 wherein said deflecting means comprises a magnet of magnetic field strength sufficient to deflect electrons from said neutral particle beam to form said beam of charged particles.

11. The apparatus of claim 1 wherein said deflecting means comprises a magnet of magnetic field strength sufficient to deflect negative ions of a particular species from said neutral particle beam to form said beam of charged particles.

12. The apparatus of claim 2 further comprising:

a beam limiting collar downstream of said deflecting means and disposed in at least a portion of said neutral particle beam while allowing a majority of said neutral particle beam to pass unimpeded through the center of said collar, said collar including means for transmitting a part of said portion of said neutral particle beam therethrough to produce at least one neutral particle beamlet;

neutral beam detector means positioned downstream of said collar for detecting particles in said neutral particle beamlet; and neutral beam deviation determining means responsive to said neutral beam detector means for determining the deviation of said neutral particle beamlet from said predetermined direction, whereby the deviation of said neutral particle beamlet is comparable to the deviation of a corresponding said charged particle beamlet to define the instantaneous transfer characteristics of said deflecting means.

13. The apparatus of claim 12 wherein said means for transmitting a part of said portion of said neutral particle beam transmits a plurality of discrete neutral particle beamlets and said apparatus further includes a corresponding plurality of neutral beam detector means.

14. The apparatus of claim 13 wherein said plurality of said neutral particle beamlets comprises four neutral particle beamlets arranged in quadrature adjacent the periphery of said neutral particle beam.

15. A nonintrusive method for determining the deviation of a neutral particle beam from a reference direction, where the neutral particle beam is derived from a composite particle beam also containing charged particles having substantially the same directional characteristics as neutral particles of the neutral particle beam, said method comprising the steps of systematically deflecting at least a portion of said charged particles a fixed amount from said composite particle beam to form a beam of charged particles;

intercepting a portion of said charged particle beam with masking means so as to produce at least one charged particle beamlet; and determining the deviation of said charged particle beamlet from a second direction differing from said reference direction by said fixed amount as an indication of the deviation of said neutral particle beam from said known direction.

16. The method of claim 15 wherein said step of interrupting said beam of charged particles comprises the step of producing at least one charged particle beamlet taken from a location interior to the periphery of said beam of charged particles.

17. The method of claim 16 wherein the deflecting of said charged particle beam relative to said neutral particle beam is calibrated by steps comprising:

interrupting a portion of the periphery of said neutral particle beam so as to produce at least one neutral particle beamlet at a known location on said periphery;

determining the deviation of said neutral particle beamlet from said reference direction; and comparing the deviation of said neutral particle beamlet to the deviation of a corresponding said charged particle beamlet as an indication of the instantaneous transfer characteristics of a magnetic deflection system for systematically deflecting said charged particles said fixed amount.

* * * * *

UNITED STATES PATENT AND TRADEMARK OFFICE

CERTIFICATE OF CORRECTION

PATENT NO. : 4,762,993

DATED : August 9, 1988

INVENTOR(S) : Kenneth G. Moses

It is certified that error appears in the above-identified patent and that said Letters Patent is hereby corrected as shown below:

On the face, (Attorney, Agent or Firm), change "Fitch, Even, Tabin & Tabin" to --Fitch, Even, Tabin & Flannery--.

Column 4, line 39, change "Key" to --Kev--.

Column 5, line 61, change "no." to --No.--.

Column 6, line 10, change "d" to --d--.

Column 6, line 14, change "d" to --d--.

Column 6, line 15, change "d" to --d--.

Column 6, line 16, change "x" to --x--.

Column 6, line 27, change "d" to --d--.

Column 6, line 32, change "n" to --n--.

Column 6, line 33, change "b" to --b--.

Column 6, line 34, change "x" to --x--.

UNITED STATES PATENT AND TRADEMARK OFFICE

CERTIFICATE OF CORRECTION

PATENT NO. : 4,762,993

DATED : August 9, 1988

INVENTOR(S) : Kenneth G. Moses

It is certified that error appears in the above-identified patent and that said Letters Patent is hereby corrected as shown below:

Column 6, line 34, change "b" to --b--.

Column 6, line 34, change "n" to --n--.

Column 6, line 38, change "d" to --d--.

Column 6, line 40, change "d" to --d--.

Column 6, line 42, change "b" to --b--.

Column 6, line 44, change "x" to --x--

Column 7, line 36, change "righthand" to --right-hand--.

Column 12, line 7, after "of" insert --:--.

Signed and Sealed this

Seventh Day of March, 1989

*Attest:*

DONALD J. QUIGG

*Attesting Officer*

*Commissioner of Patents and Trademarks*